US006364440B2

(12) United States Patent
Donahue

(10) Patent No.: US 6,364,440 B2
(45) **Date of Patent: *Apr. 2, 2002**

(54) PLASTIC VANITY CABINET AND METHOD FOR MAKING SAME

(76) Inventor: Edward Donahue, 3149 Queens Chapel #201, Mt. Ranier, MD (US) 20712

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/074,156

(22) Filed: May 7, 1998

(51) Int. Cl.[7] ..... A47B 77/06

(52) U.S. Cl. ..... 312/228; 156/512; 156/73.1; 312/265.5

(58) Field of Search ..... 312/257.1, 140.1, 312/228, 228.1, 352, 265.5, 140; 49/506; 156/512, 73.1

(56) References Cited

U.S. PATENT DOCUMENTS 3,877,765 A * 4/1975 Hassing ..... 312/140
3,975,069 A * 8/1976 DeLucia ..... 312/262
4,396,240 A * 8/1983 Henson ..... 312/228
5,277,487 A * 1/1994 Simon ..... 312/228

OTHER PUBLICATIONS

"IntelCel™ Usage Guidelines", as published by World–Pak Corporation–The Inteplast Group, Date Unknown, pp. 1–4.

* cited by examiner

*Primary Examiner*—Peter M. Cuomo
*Assistant Examiner*—Jerry A. Anderson
(74) *Attorney, Agent, or Firm*—Erik B. Cherdak & Associates, LLC

(57) ABSTRACT

A plastic vanity and method for making the same. The vanity includes a base having two side walls, a bottom member forming a shelf inside the base, a rear brace member, a front brace member, and a front opening disposed between the front brace member and the bottom member. The two side walls, the bottom member, the rear brace member, and the front brace member are constructed from a plastic material. The vanity also includes a door swingably mounted to the base and which is configured to cover the front opening. The door, like the base, is constructed from the plastic material. The vanity also has a top opening disposed at the top thereof which is configured to receive a sink top or other surface structure.

2 Claims, 2 Drawing Sheets

PLASTIC VANITY CABINET AND METHOD FOR MAKING SAME

BACKGROUND OF THE INVENTION

1. Field of the Invention

The present invention relates vanity cabinets used to support plumbing fixtures in residential and commercial environments.

2. Description of the Related Art

Large residential and commercial communities such as large apartment complexes often face an endless routine of fixture repair and replacement. In a transient community such as in a college town where people often stay in their leased apartments for relatively short periods of time, fixture (cabinets, vanities, table tops, etc.) repair and replacement have become time consuming and costly activities. Apartment complexes, for example, often have to employ maintenance crews that are tasked with rotating through a set of apartments to repair and replace damaged and destroyed kitchen cabinets, bathroom vanities, etc. to ensure that apartments may be rented and sold after current tenants leave their tenancies.

The problems faced by community operators often are compounded by the realities associated with managing transient communities. For example, it is well known that people often do not care for rented homes and apartments as they would if they owned the same. As such, people are less like likely to care when substances such as water, household cleaners and other liquids come into contact with the surfaces of bathroom vanities and the like. And, when such substances are allowed to remain on the surfaces of bathroom vanities, for example, mold, mildew, and other deteriorating effects can occur. Since many structures like bathroom vanities are constructed from wood (e.g., particle board, composite woods, etc.) and the like, such deteriorating effects are compounded as woods will quickly rot and decay.

To combat the management headaches and costs associated with fixture repair and replacement and to minimize the deteriorating effects caused as a result of wear and tear, operators of apartment complexes, for example, have resorted to applying thick coats of paint to fixture surfaces, replacing broken and rotten parts, and have engaged in routine, costly replacement whether needed or not. As such, operators of large communities have not been successful at minimizing costs associated with fixture preservation and the like.

Thus, there exists a need to provide new and improved dwelling fixtures (e.g., bathroom vanities, etc.) that are constructed of durable materials that can stand the test of time and excessive wear and tear. Such new and improved fixtures need be constructed from materials that will withstand prolonged contact with water and other substances (e.g., liquids, etc.) that have not been tolerated by structures made from conventional materials like wood. To be viable, such new and improved fixtures need to be constructed from materials that will allow operators of apartment complexes, for example, to establish and maintain aesthetic plans for the benefit of tenants and the like.

SUMMARY OF THE INVENTION

The present invention addresses the limitations and problems associated with the related art by providing a vanity cabinet that is constructed from a plastic material. Such a vanity cabinet (hereinafter "vanity") will provide certain benefits not hereto realized by prior vanity cabinet structures. For example, a vanity constructed in accordance with the present invention is by its very nature water resistant which, in turn, makes the same safe from harmful effects often caused by water and other liquids (e.g., mold, mildew, etc.). Additionally, a vanity constructed in accordance with the present invention is lighter than prior vanities that are typically constructed from wood and the like. Such lighter construction allows a vanity according to the present invention to be more easily shipped and assembled. And, because plastic material is used to construct a vanity in accordance with the present invention a wide variety of finishes such as paint, laminates, print images (e.g., screen printed images), or other coverings (e.g., adhered image bearing sheets of material) may be easily applied to suit particular aesthetic requirements.

The present achieves the stated benefits by providing a new and novel vanity for use in bathrooms, for example, which is constructed from a plastic material and method for making the same. The vanity includes a base having two side walls, a bottom member forming a shelf inside the base, a rear brace member, a front brace member, and a front opening disposed between the front brace member and the bottom member. The two side walls, the bottom member, the rear brace member, and the front brace member are constructed from a plastic material. The vanity also includes a door swingably mounted to the base and is configured to cover the front opening. The door, like the base is constructed from the plastic material. The vanity also has a top opening disposed at the top thereof which is configured to receive a sink top.

The present is discussed in detail below with regard to the attached drawing figures which are next described.

BRIEF DESCRIPTION OF THE DRAWINGS

The present invention is described in detail below with reference to the following drawing figures of which.

DETAILED DESCRIPTION OF THE PREFERRED EMBODIMENTS

Figure 1:
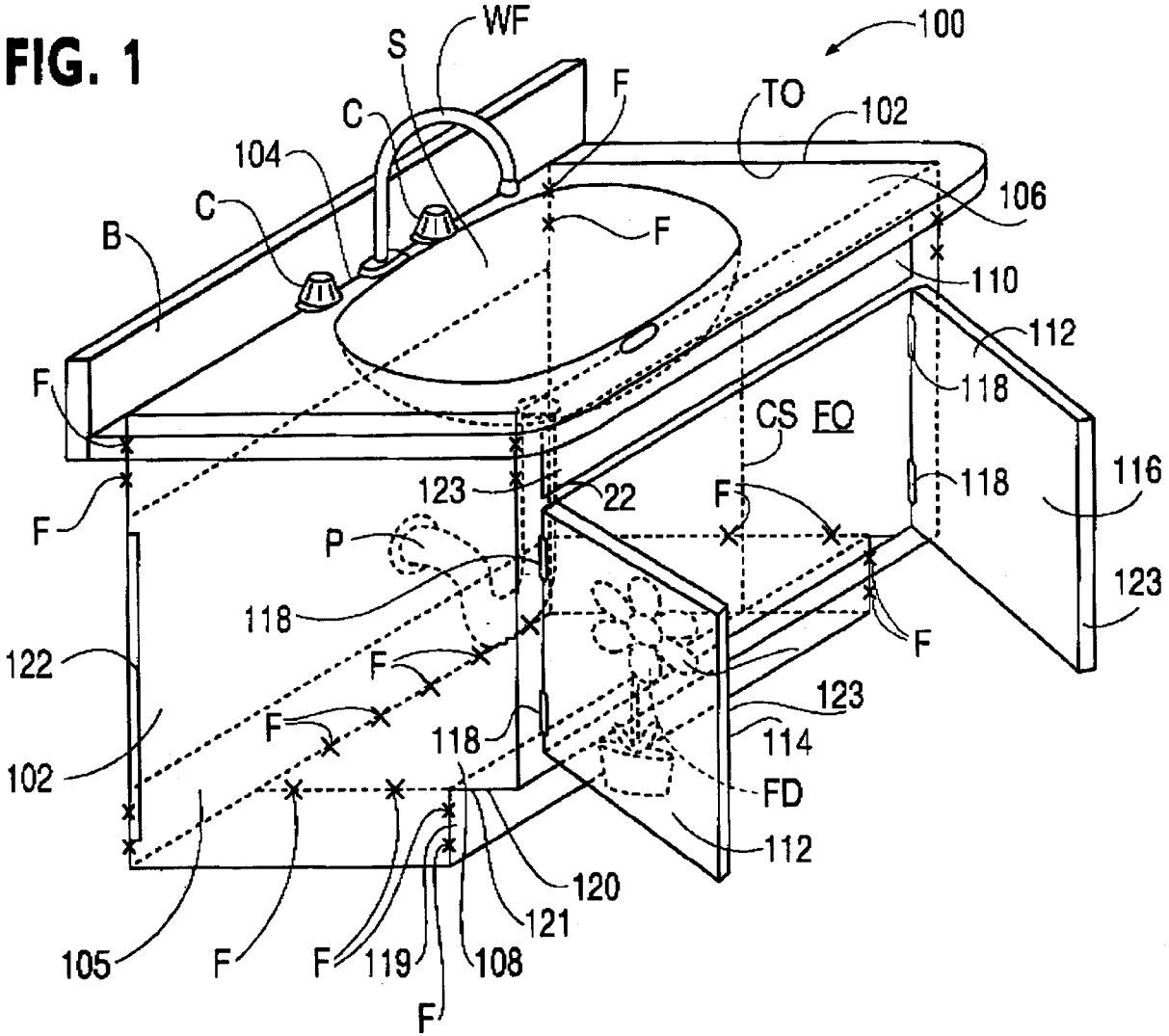
FIG. 1 is an oblique diagram of a vanity of uniform construction according to a preferred embodiment of the present invention

The present invention is now discussed in detail with reference to the drawing figures that were briefly described above. Unless otherwise indicated, like parts are referred to with like reference numerals.

Referring now to FIG. 1, depicted therein is an oblique diagram of a vanity/cabinet of uniform construction according to a preferred embodiment of the present invention. In particular, vanity 100 includes a base constructed from a set of side walls 102, a rear top brace member 104 (partially shown in phantom lines), a rear bottom brace member 105 (shown in phantom lines), a front brace member 106, a bottom member 108 that forms a shelf inside of base 100, a decorative plaque member 110 mounted on front brace member 106, and doors 112 swingably and respectively mounted on side walls 102 via hinges 118. Doors 112 are manually operable via knobs 114, which may be respectively mounted to doors 112 via screw fasteners 116, respectively.

The exemplary embodiment referred to as vanity 100, has been constructed having particular dimensions. For example, vanity 100 has a width dimension of d1, a depth dimension of d2, and a height dimension of d3. Such dimensions may be standard or of any particular setting. An exemplary set of dimensions includes d1 being set to 22 inches, d2 being set to 16 inches, and d3 being set to 30 inches. Such dimensions may vary depending on particular design considerations and the like. Accordingly, such exemplary dimensions are in no way intended to limit the present invention.

A notch section 121 of each side wall 102 of vanity 100 reveals a kick area 120. Accordingly, a kick plate 119 is mounted to side walls 102 at bottom ends thereof. The kick area 120 is totally encased by kick plate 119 and a bottom surface of bottom member 108.

As doors 112 are mounted on hinges 118 to side walls 102, doors 112 are swingable to allow access to the interior of the base of vanity 100 through a front opening FO thereof.

Inside of vanity 100 L-shaped brackets 122 (e.g., L-shaped aluminum corner braces, etc.) may be mounted on the inner surfaces of side walls 102, respectively, to add stability to vanity 100 and to mount vanity 100 against a vertical wall surface, etc. Accordingly, brackets 122 are optional and may be used to fasten vanity 100 to a wall or other vertical surface to stabilize and secure vanity 100 in a fixed position.

In FIG. 1, preferred fastening positions are indicated by the letter F. Such fastening positions are located and disposed to allow the above-described component parts of vanity 100 to be secured to each other to achieve a self-standing vanity for use in, a bathroom environment, etc. Although screws, injected nail fasteners, bolts, etc. (i.e., insertable fasteners) may be used to fasten the component parts of vanity 100, the same are not absolutely required. Alternatively or in combination with other fastening systems (e.g., screws, bolts, nails, etc.) depending on the material (e.g., plastics) that is used to construct the component parts of vanity 100, other fastening systems such as adhesive systems (glues, epoxies, cements, etc.) may be used.

Preferably, vanity 100 is constructed of plastic or other polymer material such as poly-vinyl chloride (PVC). In particular, all component structures with the exception of L-shaped brackets 122, hinges 118, knobs 114, and screw fasteners 116 (e.g., vanity hardware) are made of plastic material such as PVC or other similar materials. The structures forming the vanity base including side walls 102, rear top brace member 104, rear bottom brace member 105, front brace member 106, bottom member 108, decorative plaque member 110, doors, 112, and kick plate 119 are fastened together to form the base of vanity 100 at fastening positions as illustrated in FIG. 1. If PVC or other similar plastic materials are used to form the component parts of vanity 100, and if solvent-based glues and adhesives are used to join the same, then the preparation of the surfaces of such PVC members is very important. In particular, surfaces preferably should be free of moisture, grease, or any other foreign particles. Isopropyl alcohol and naphtha cleaners/compounds may be used to clean the surfaces in preparation for bonding (gluing) to form the base of vanity 100. It should be noted that if PVC is the material of choice that is used to construct vanity 100, and once the surfaces of such structures are cleaned, then MEK (methyl ethyl ketone), THF (tetra hydro furane) or PVC pipe adhesive (a.k.a. "pipe glue") can be applied to join the respective component structures together. Glue joints, in any case, should have a close fit and tolerance to ensure lasting stability, etc.

In some cases where certain plastics are used to form the component parts of vanity 100, such as in the case of PVC, welding techniques may be used to fasten such component parts together. Various welding joints may be constructed (e.g., fillet joints, "V" joints, etc.). In any case, good quality Type I PVC or plastic welding rods should preferably be used.

The above described component parts may be individually sight constructed via conventional carpentry techniques such as by cutting one or more sheets of plastic material. For example, sheets or boards of plastic material may be used to form such component parts by cutting the same using a table saw arrangement and, possibly, through use of a hack saw. In particular, a material known as INTECEL™ which is manufactured and marketed by WORLD-PAK CORPORATION and, in particular, sheets of the same (e.g., 4 ft.×8 ft. sheets) may be used to construct the component parts of vanity 100. The INTECEL™ material may be cut using most standard types of saw blades that are used to cut sheets of wood such as plywood, etc. Saw blades made for cutting plastics have been found to give the best results. Carbide tipped blades perform even better. When selecting a saw blade, care should be taken not to use blades with very fine teeth. Fine teeth may result in excessive heat build-up caused by friction an may burn the edges of the plastic material. Rough edges caused from blade cutting may be reduced by keeping saw blades sharp at all times or sanding the edges after cutting.

Figure 2A:
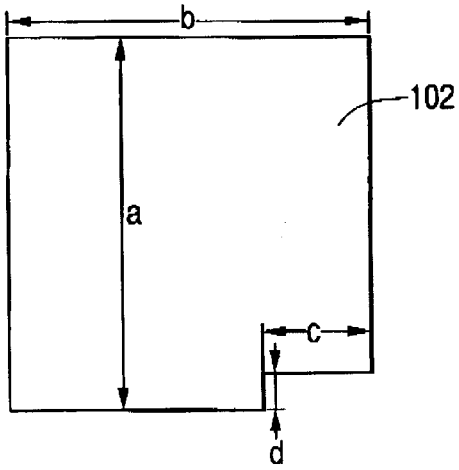
FIG. 2A is a diagram of the side wall of the vanity shown in FIG. 1.
Figure 2B:
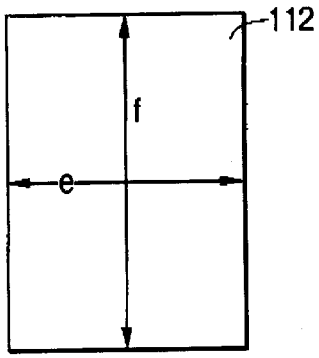
FIG. 2B is a diagram of a door of the vanity shown in FIG. 1.
Figure 2C:
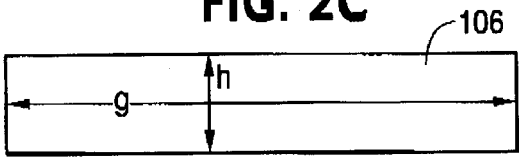
FIG. 2C is a diagram of the front brace member of the vanity shown in FIG. 1.
Figure 2D:
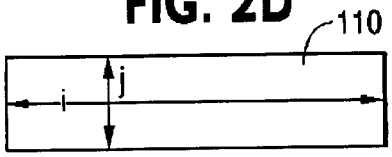
FIG. 2D is a diagram of the decorative plaque member of the vanity shown in FIG. 1.
Figure 2E:
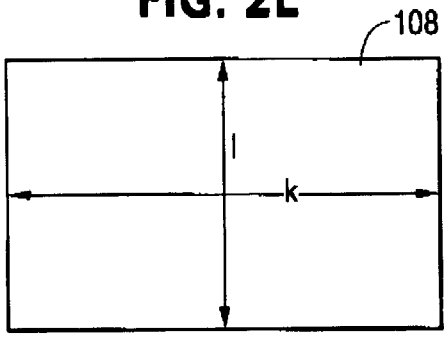
FIG. 2E is diagram of the bottom member of the vanity shown in FIG. 1.
Figure 2F:
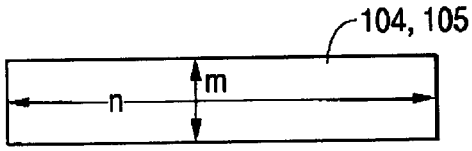
FIG. 2F is a diagram of the rear brace members of the vanity shown FIG. 1.
Figure 2G:
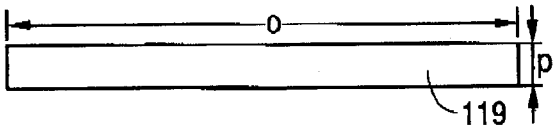
FIG. 2G is a diagram of the kick plate of the vanity shown in FIG. 1.

To further illustrate the cuttings that need be carried out to construct the component parts of vanity 100, reference is now made to FIGS. 2A–2G. In particular, as shown in FIG. 2A, side walls 102 may be cut to have dimensions a, b, c, and d (e.g., 33 inches, 15 and ⅝ inches, 1 and ½ inches, 4 inches, respectively). As shown in FIG. 2B, doors 112 may be cut to have dimensions e×f (e.g., 22 and ¾ inches×10 and ⅛ inches). As shown in FIG. 2C, front brace member 106 may be cut to have dimensions g×h (e.g., 21 inches×7 inches). As shown in FIG. 2D, decorative plaque member 110 may be cut to have dimensions I×j (e.g., 22 and ¾ inches×10 and ⅛ inches). As shown in FIG. 2E, bottom member 108 may be cut to have dimensions k×I (e.g., 15 and ⅝ inches×21 inches). As shown in FIG. 2F, rear brace members 104 and 105 may be cut to have dimensions n×m (e.g., 21 inches×7 inches). And, as shown in FIG. 2G, kick plate 119 may be cut to have dimensions o×p (e.g., 21 and ¾ inches×4 inches).

The dimensions listed above assume a uniform thickness of the plastic sheet material that is used to construct the above-mentioned component parts of vanity 100 (e.g., material having a ½" thickness). The present invention, however, is not so limited. To the contrary, it may be desirable to use sheet material that varies in thickness for some or all of the component parts of vanity 100. For example, side walls 102 may be constructed using sheet material of ¾" thickness while decorative plaque member 110 may be constructed using ¼" thick material. Such thickness' may vary to suit particular design requirements and structural specifications.

Also, it should be understood that although cutting techniques are acceptable to construct the component parts of vanity 100 to have the aforementioned exemplary dimensions, the present invention is not so limited. To the contrary, other construction techniques may be employed to derive component parts having the aforementioned exemplary dimensions. For example, the component parts of vanity 100 may be formed via plastic formation and molding techniques—such as in cases where large volumes of vanities are to be produced. Such techniques will be readily apparent to those skilled in the art.

In the case of mounting hardware to component parts that make up vanity 100 (e.g., knobs 114 mounted to doors 112), holes may be drilled through a plastic material like the INTECEL™ product using conventional wood drilling techniques. High quality drill bits designed for drilling ferrous metals are suggested.

If routing and milling techniques are to be incorporated into the construction process of vanity 100 (e.g., for rounded decorative edges, etc.), a product like the INTECEL™ product may be slotted, beveled, rabbeted, etc. with a router or shaper. Carbide tipped bits have been found to provide best results.

In addition to carpentry techniques that may be used to form the component parts of vanity 100, other forming techniques may be employed. For example, depending on the volume of vanities or other similar cabinets that are to be constructed, molding techniques to mold such component parts to specification (e.g., size, weight, etc.) may be performed. In particular, injection or form molding techniques may be carried out to construct side walls 102 having particular dimensions and characteristics. Such alternative formation techniques will avoid scraps and lost material often realized from sheet cutting carpentry techniques.

Once the base of vanity 100 is constructed, a top opening "TO" will be formed. There after, a vanity sink top S may be (removably or fixedly) mounted on the base of vanity 100. Vanity sink top S is a conventional sink top arrangement having a sink and pluming fixture holes C. A water faucet WF (shown in phantom lines) may be mounted on top of vanity sink top S in a conventional way.

Once vanity sink top S is mounted onto the base of vanity 100 and, in particular, at top opening TO thereof, pluming fixtures P maybe mounted at the interior base of the sink portion of vanity sink top S and also to appropriate pluming lines in a conventional way.

After vanity 100 is constructed, it may be decorated to suit particular aesthetic plans. For example, a decorative floral design FD (shown in phantom lines) or other design (including woodgrain designs to simulate wood, metal finish design to simulate metal finishes, etc.) may be painted, printed (e.g., screen-printed), or otherwise affixed to vanity 100 (e.g., on doors 112, etc.). If PVC sheeting is used to construct vanity 100 (e.g., as in the case of the INTECEL™ product as described above), painting, screen printing, photograph/image mounting, etc. may be performed. If painting is to be performed to decorate vanity 100, paints from the SHERWIN WILLIAMS COMPANY may be used (e.g., POLANE—polyurethane based paint). If screen printing is to be used to decorate vanity 100 (with decorative floral designs, etc.) inks from the COLONIAL PRINTING INK CORPORATION may be used (e.g., solvent based ink C99-GLOSS VINYL). In the case that photo mounting techniques are to be used to decorate vanity 100, it is suggested to use pressure sensitive spray adhesives or transfer adhesive films with resin coated papers that can be peeled from the adhesive when preparing to mount a photograph or other paper/plastic message/image carrying substrate. Alternatively, contact-cements may be used.

Additionally, other laminate materials may be placed on the outer, exposed surfaces of vanity 100 (e.g., on the outer surfaces of doors 112) to effect a particular look and feel. In the case that laminates (e.g., FORMICA brand laminates, etc.) are to be used, the same can simply be adhered to the surfaces of the components parts of vanity 100 as would normally be done with wood and other substrates. Adhering compounds like contact-cement laminate glue, etc. may be used. The use of such laminates will be immediately understood by those skilled in the art. For example, the surfaces of the component parts of vanity 100 such as doors 112, etc. including the edges 123 thereof may be laminated to achieve a particular aesthetic specification.

It should be noted that vanity 100 is an exemplary embodiment and is intended to illustrate the novel features of the present invention. It will be immediately understood by those skilled in the art that many changes and modifications may be made. For example, although two rear braces are used to stabilize vanity 100, a single back plane member may be used which may totally enclose vanity 100. Also, although two doors 112 are shown, a single door or any number of doors may also be arranged. If more than two doors are to be installed, it may be necessary to include vertically disposed center supports CS with in front opening FO.

Also, although a bathroom vanity fixture has been shown and described, the present invention is not so limited. It is certainly envisioned that other cabinet structures such as other cabinets (e.g., kitchen sink vanity cabinets, etc.) and the like may be constructed in accordance with the present invention.

Additionally, although a vanity sink top S has been shown in FIG. 1, the present invention is not so limited. To the contrary, other tops including, but not limited to, flat horizontal surfaces may be incorporated. If a flat surface is to be incorporated, the same may be constructed (formed, cut, etc.) from a plastic material that is used to construct the base of vanity 100.

Also, it should be noted that as the present invention provides a vanity of uniform construction and, in particular, a plastic vanity, there are certain benefits not realized by prior wood or similarly constructed vanities. For example, as the vanity of the present invention is constructed and otherwise formed from plastic material, the same is not susceptible to water damage and the like often realized by wood vanities in moist bathroom environments. Accordingly, the vanity of the present invention is water resistant, water safe. Such water resistance (water-safeness) will allow vanity 100, for example, to be free from mildew, rotting, and other maladies that are often realized by wood fixtures like vanities in bathroom environments.

Additionally, as plastics are lighter than conventional materials used to construct vanities and the like (e.g., particle board), the same are easier to work with, cut, ship, and generally manage.

Thus, having fully described the present invention by way of example with reference to the attached drawing figures, it will be readily appreciated that many changes and modifications may be made to the invention and to any of the exemplary embodiments shown and/or described herein without departing from the spirit or scope of the invention which is defined in the appended claims.

What is claimed is:

1. A method for making a frameless, self supported plastic vanity, comprising the steps of:

constructing a base having two side walls, a bottom member forming a shelf inside said base, a rear brace member, a front brace member, and a front opening disposed between said front brace member and said bottom member, said two side walls, said bottom member, said rear brace member, and said front brace member being constructed from cut plastic sheeting material having a thickness of at least 0.25 inches; and mounting a door to said base, said door being swingably mounted to said base and configured to cover said front opening, said door being constructed from said cut plastic sheeting material having a thickness of at least 0.25 inches, whereby said frameless, self-supported plastic vanity is produced as a result of completion of said constructing and mounting steps.

2. A method for making a frameless, self supported plastic vanity, comprising the steps of:

constructing a base having two side walls, a bottom member forming a shelf inside said base, a rear brace member, a front brace member, and a front opening disposed between said front brace member and said bottom member, said two side walls, said bottom member, said rear brace member, and said front brace member being constructed from cut plastic sheeting material; and mounting a door to said base, said door being swingably mounted to said base and configured to cover said front opening, said door being constructed from said cut plastic sheeting material, whereby said frameless, self-supported plastic vanity is produced as a result of completion of said constructing and mounting steps.

* * * * *